United States Patent [19]

Baldassari

[11] Patent Number: 4,594,119

[45] Date of Patent: Jun. 10, 1986

[54] AUTOMATIC CENTERING OF MOLTEN METAL POUR SPOUT METERING PIN

[75] Inventor: Giuseppe Baldassari, Carrollton, Ga.

[73] Assignee: Southwire Company, Carrollton, Ga.

[21] Appl. No.: 635,317

[22] Filed: Jul. 27, 1984

Related U.S. Application Data

[62] Division of Ser. No. 231,985, Dec. 8, 1980, abandoned.

[51] Int. Cl.[4] ..... B32B 35/00; B22D 11/06

[52] U.S. Cl. ..... 156/94; 156/294; 156/391; 29/464; 164/434; 222/591

[58] Field of Search ..... 156/94, 98, 152, 294, 156/349, 391; 29/428, 464, 559, 402.11; 269/47, 49, 52; 222/591, 592, 599, 600, 566; 81/13; 164/434, 437

[56] References Cited

U.S. PATENT DOCUMENTS

| | | | |
|---|---|---|---|
| 2,447,491 | 8/1945 | Corley | 269/49 |
| 2,836,866 | 6/1958 | McMillin | 222/591 X |
| 3,331,539 | 7/1967 | Cofer et al. | 222/591 X |
| 3,415,427 | 12/1968 | Sharp | 222/591 X |
| 3,422,881 | 1/1969 | Properzi | 164/434 |
| 3,528,479 | 9/1970 | Cole et al. | 164/434 X |
| 3,673,039 | 6/1972 | Todd | 156/294 X |
| 3,903,954 | 9/1975 | Richardson | 164/434 |
| 4,098,321 | 7/1978 | Wilson et al. | 164/434 X |

*Primary Examiner*—Edward Kimlin
*Assistant Examiner*—Ramon R. Hoch
*Attorney, Agent, or Firm*—Van C. Wilks; Herbert M. Hanegan; Stanley L. Tate

[57] ABSTRACT

Disclosed is an apparatus and method for automatically centering a metering pin in the pouring spout of a molten metal pouring pot.

8 Claims, 5 Drawing Figures

AUTOMATIC CENTERING OF MOLTEN METAL POUR SPOUT METERING PIN

This is a division of application Ser. No. 231,985 filed on Dec. 8, 1980, now abandoned.

BACKGROUND OF THE INVENTION

1. Field of the Invention

The present invention relates generally to molten metal processing and specifically to an apparatus and method for automatically centering a metering pin in the pouring spout of a molten metal pouring pot.

2. Description of the Prior Art

Spouts for pouring molten metal are well known in the prior art. Examples of such spouts are disclosed in U.S. Pat. Nos. 3,628,706, 3,673,039, 3,752,372 and 3,805,877. Several methods of controlling flow of molten metal during pouring are also known in the prior art. U.S. Pat. No. 3,182,360 illustrates a method of valve control external of the pouring pot. U.S. Pat. No. 3,384,150 illustrates a pouring method operated by gas pressure. U.S. Pat. Nos. 3,746,072 and 3,903,954 disclose methods of pouring molten metal with a unique spout purged of air and U.S. Pat. No. 4,098,321 teaches pouring molten metal at a constant flow rate by maintaining the molten metal pressure depth. Metering pin type molten metal control devices are also very well known in the prior art. U.S. Pat. No. 2,615,216 illustrates a yielding nozzle which conforms to a plug. U.S. Pat. No. 3,331,539 discloses a metering device which has long service life because direct exposure to heat is limited only to the metering pin. U.S. Pat. No. 3,422,881 illustrates a conventional metering rod within a spout which comprises a continuous casting belt. U.S. Pat. No. 3,452,808 illustrates another conventional metering rod within an adjustable spout and U.S. Pat. No. 3,528,479 shows a metering pin controlled by a gamma radiation device. Additionally, U.S. Pat. No. 3,958,730 illustrates a four part stopper rod plug assembly which is claimed to always have complete shut off capability regardless of any warping of the components thereof.

Although numerous advances have been made in methods of pouring metal and particularly in the use of metering pins to control molten metal flow, there is no accurate method in the prior art of initially centering the metering pin in the spout of the pour pot. The prior art method of centering is by trial and error which results in excessive down time and inaccuracy which in turn often results in vortices, undesired turbulence, imprecise flow and molten metal spills.

SUMMARY OF THE INVENTION

The present invention solves the prior art problems associated with metering pin misalignment by providing an apparatus and method for automatically centering a metering pin in the pouring spout of a molten metal pouring pot.

Thus a major object of the present invention is to provide an apparatus and method for automatically centering a metering pin in the pouring spout of a molten metal pouring pot.

A further object of the present invention is to provide an apparatus and method for accurately centering and aligning a metering pin in the pouring spout of a molten metal pouring pot during initial assembly of the pouring pot, pouring spout, metering pin and metering pin control mechanism.

Another object of the present invention is to reduce down time associated with centering of a metering pin.

Another object of this invention is to increase accuracy of metering pin operation.

Still another object of this invention is to substantially eliminate vortices and other undesirable turbulence in the pouring spout of a molten metal pouring pot caused by inaccurate metering pin alignment.

A further object of this invention is to provide for precise control of molten metal flow.

Still another object of the present invention is to prevent molten metal spills by providing for accurate total discontinuance of molten metal flow.

Yet another object of this invention is to provide an apparatus and method for accurately centering and aligning a metering pin in the pouring spout of a molten metal pouring pot during replacement of pouring pot, pouring spout, metering pin or metering pin control mechanism components or details parts thereof.

Another object of this invention is to provide for homogeneous molten metal flow.

Other objects, advantages and novel features of the invention will be apparent from a reading of the following detailed description when considered with the accompanying drawings.

DETAILED DESCRIPTION OF A EMBODIMENT

Referring now in detail to the drawings, wherein like numerals indicate like elements throughout the several views.

Figure 1:
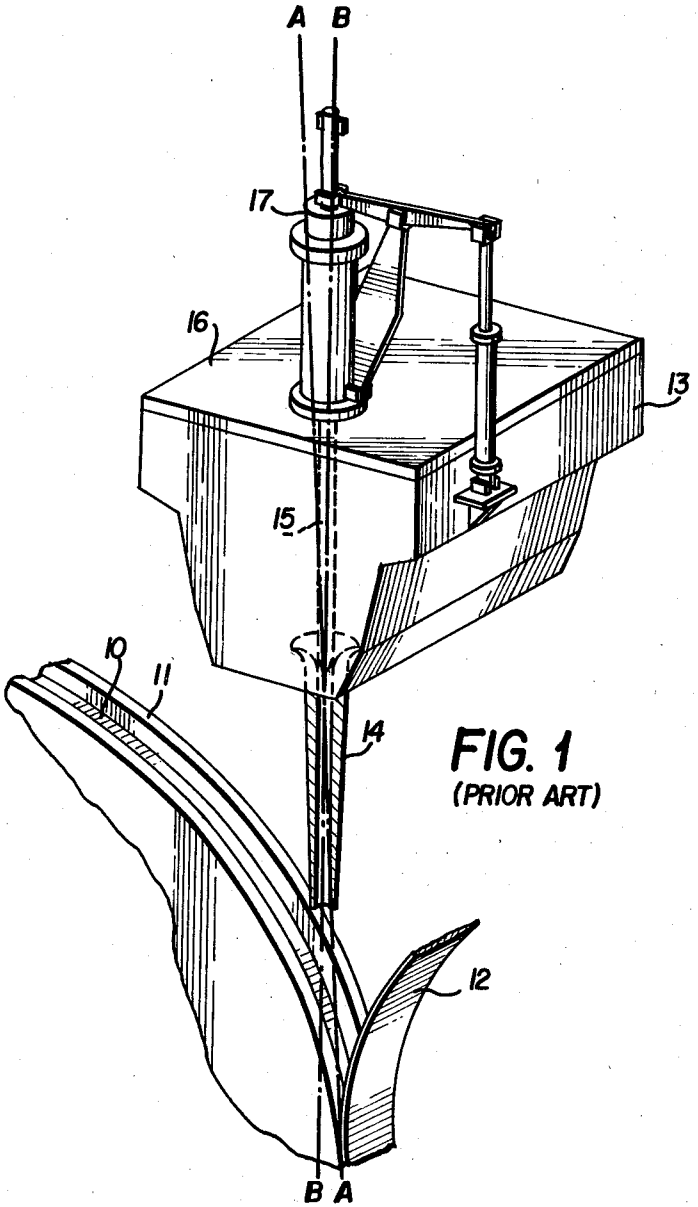
FIG. 1 (PRIOR ART)
FIG. 1 is an elevation of a prior art molten metal pour pot with a prior art metering pin control system.

FIG. 1 illustrates a typical prior art molten metal pouring system combining the teachings of U.S. Pat. Nos. 3,331,539 and 4,098,321 to pour molten metal into the casting groove 10 of a conventional wheel 11 and belt 12 continuous casting machine. The prior art system comprises a pour pot 13, a pour spout 14, a metering pin 15, a pour pot cover 16 and a metering pin control tower 17. Assembly of the prior art apparatus requires attaching the spout 14 to the pot 13 with the longitudinal axis of the spout 14 aligned along a first approximated axis A—A which will be the longitudinal axis of the path of metal flow from the pour pot 13. The pour pot cover 16, the metering pin control tower 17 and the metering pin 15 are then placed on the pour pot 13 and the cover 16 and tower 17 are manipulated in an attempt to align the longitudinal axis B—B of the metering pin 15 with the longitudinal axis A—A of the spout 14 to assure proper seating of the pin 15 in the spout 14. Such a task is only remotely possible. To make alignment of the B—B axis and the A—A axis easier, the prior art normally set the A—A axis in a generally vertical alignment. Then by resting the bottom tip of the pin 15 in the top opening of the spout 14 and tediously adjusting the cover 16 and tower 17 the metering pin 15 was sight aligned to approximately vertical. Thus relatively accurate alignment of the B—B axis to the A—A axis was possible with sufficient skill, patience, and time.

Vertical alignment of the spout 14 created another alignment problem. Since the curvature of the casting groove 10 of a wheel 11 and belt 12 casting machine is never vertical, the prior art had to develop complicated pour pot positioning apparatus to move a vertically aligned apout 14 into tangential relationship with the casting groove 10 to achieve proper molten metal placement in the groove 10.

As an option to use of complicated pour pot positioning means, the prior art initially set the pouring spout 14 in the pour pot 13 at an angle convenient for proper alignment of the spout 14 with the casting groove 10. This further complicated alignment of the metering pin 15 with the spout 14, and made alignment of axis B—B with axis A—A impossible.

Continuous casting of molten metal with prior art wheel and belt casting systems therefore involved improper alignment of the pour spout 14 with the casting groove 10, or improper alignment of the metering pin 15 with the pour spout 14 or both. Such casting conditions have led to poor quality cast products, excessive machine down time, undesirable turbulence in the pour spout, molten metal spills, freeze up of pour spouts, and a generally dangerous and relatively unproductive work atmosphere.

Figure 2:
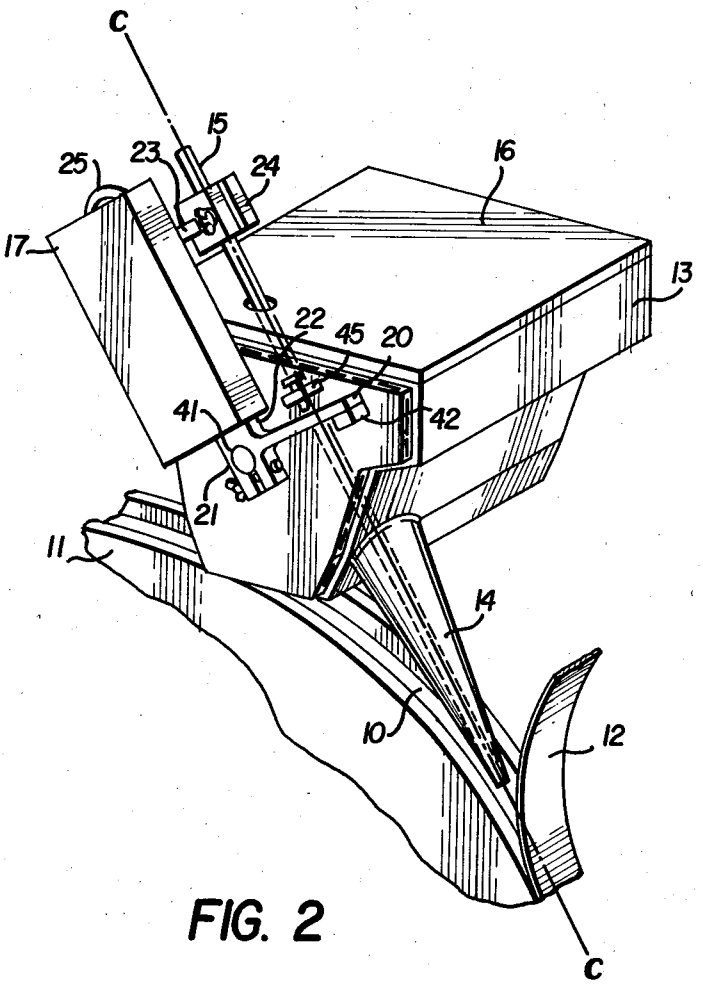
FIG. 2 is an elevation of the preferred embodiment of the present invention.

FIG. 2 illustrates an embodiment of this invention. Correct alignment of the metering pin 15 is a function of the most desirable angle of alignment of the pour spout 14 with the casting groove 10 and alignment of the pour pour spout 14 is a function of the metering pin 15 alignment. A longitudinal axis C—C of the proper molten metal exit path from the pot 13 into the casting groove 10 is first determined after which a preferable location of the pour pot 13 is selected. After the above steps have been completed, the exact path of the predetermined axis C—C through the pour pot 13 while the pour pot 13 is in the preferred location relative to a conventional wheel and belt type casting machine and, the location of the longitudinal axis of the metering pin 15 coincident with the predetermined axis C—C are then computed. A metering pin control means comprising metering pin control tower 17 is adapted to move the metering pin 15 along the predetermined path coincident with axis C—C, and a pour pot cover 16 is adapted to cover the top of the pour pot 13 except the area of the predetermined path. Construction and placement of the pouring mechanism is now a function of axis C—C.

Figure 3:
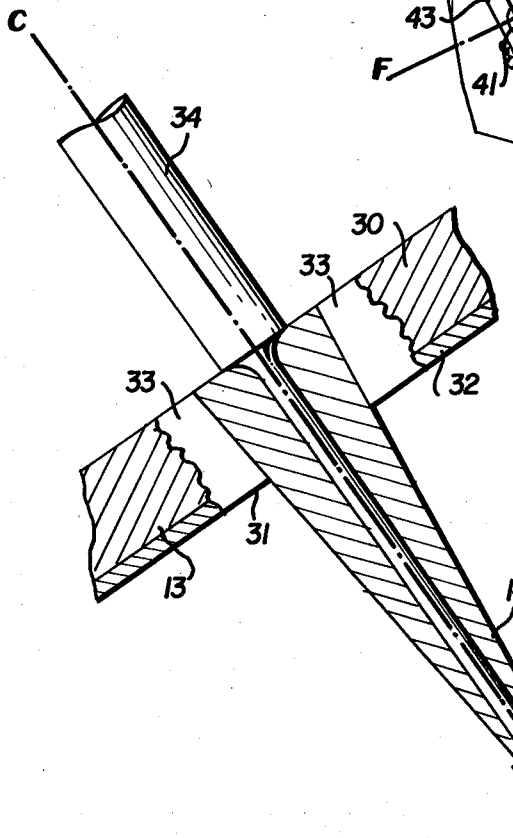
FIG. 3 is a cross sectional view of the pouring spout area of the pouring pot of the present invention.

A molten metal pouring spout 14 must be frequently replaced because it wears rapidly due to the heat of the continuous stream of molten metal passing through it and because of mechanical wear as a result of seating of the metering pin 15. As FIG. 3 illustrates, the pouring spout 14 is generally a funnel shaped refractory spout. At its thickest spot, the refractory of the spout 14 is only about an inch thick which also accounts for the frequency of replacement. Such a spout 14 will withstand only about twenty hours of use while the much thicker pour pot refractory 30 lasts for several months. Replacement of spout 14 requires removal of the entire pouring mechanism from the immediate casting area, and cooling of the pot 13 and spout 14. The spout 14 is then removed from the pot 13 by forming a large aperture in the pot 13 and around the base of the spout 14. Circular aperture 31, the axis of which coincides with axis C—C, is located in outer shell 32 of the pour pot 13 for this purpose when spout 14 is removed, cement 33 which bond the spout 14 to refractory 30 and to the outer shell 32 of the pour pot 13 is removed also.

To replace the spout 14 the long axis of the spout 14 must be aligned so that it coincides with predetermined axis C—C. To accomplish this, the spout 14 is placed on the lower end of a straight alignment rod 34 which is adapted to snugly receive, pass through the center of the spout 14 and hold the spout 14 by means of an outer surface which corresponds to the inner surface of the spout 14 so that each time a pour spout 14 is mounted on the alignment rod 34 substantially identical alignment and positioning results. A threaded portion of the alignment rod 34 extends through the tip of spout 14 and a nut 35 is fastened thereon to thus providing a means to temporarily secure the spout 14 to the alignment rod 34 in concentric relationship. The upper end of the alignment rod 34 is placed in the control tower 17 of FIG. 2 and secured at a point where the base of the spout 14 is substantially even with the inner pour pot refractory surface 30. Fresh cement 33 is then applied to attach the spout 14 to the pot 13. When the cement is dry, the spout 14 is securely affixed and correctly aligned with axis C—C.

To effect efficient spout 14 replacement a large supply of identical spouts 14 must be available. Several identical pour pots 13 provide the ability to quickly replace pots 13 having worn spouts 14 with pots 13 having new spouts 14 while allowing hot pots 13 to cool, cooled pots 13 to be refitted with new spouts 14, and freshly cemented pots 13 to dry. Similarly, identical alignment rods 34 and nuts 35 are used to align and hold spouts 14 during cementing and drying. After drying, the rods 34 are removed and the reworked pots 13 are ready for use with a casting machine.

Figure 5:
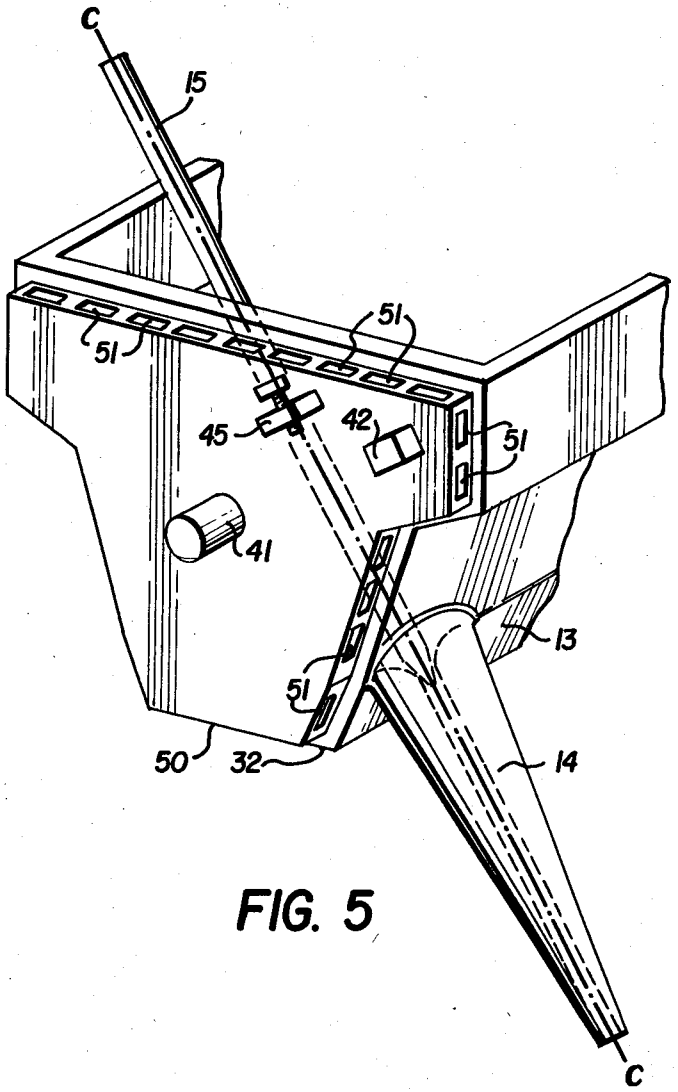
FIG. 5 is an enlarged elevation of the end plate, metering pin and pour spout of the present invention.
Figure 4:
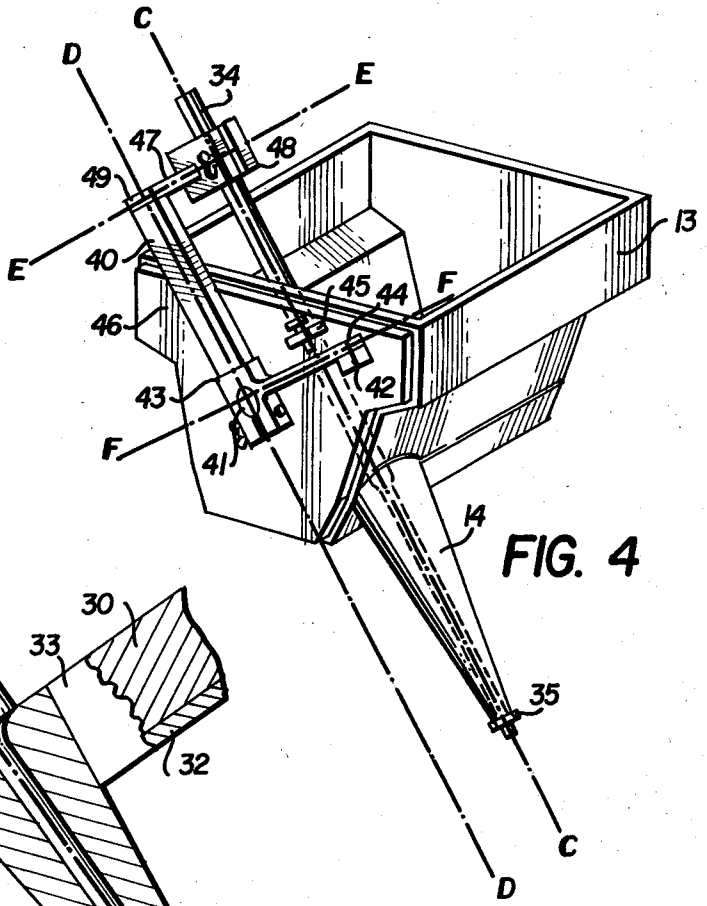
FIG. 4 is an elevation of the alignment means and pour pot of the present invention.

The metering pin control tower 17 FIG. 2 is much more expensive than the rest of the pouring mechanism components. To leave a tower 17 on each pour pot 13 during reworking of the pots 13, would create expensive duplication, therefore, the alignment jig 40 of FIG. 4, having identical alignment as tower 17, is used in place of the tower 17 to hold the alignment rod 34 in mechanically correct relationship with axis C—C. As FIG. 4 illustrates, the alignment jig 40 is releasably secured to the pour pot 13 at pivot 41 and stop block 42. To secure the alignment jig 40 to the pot 13, a clamping portion 43 of the alignment jig 40 slides onto the pivot 41 whie an alignment arm 44 of the alignment jig 40 slides between a stop block 42 and a vise 45 which are substantially linearly aligned with pivot 41. The vise 45 is tightened thus rotating the alignment jig 40 and pressing the alignment arm 44 toward the stop block 42 until the alignment arm 44 is securely contacting the stop block 42 in rotation limiting contact. In this predetermined position the longitudinal axis of the alignment arm 44 is coincident with a predetermined axis F—F. The clamping portion 43 of the alignment jig 40 is then tightened around pivot 41 to provide additional securement and to assure stability. In this position, the longitudinal axis of the spine 46 of the alignment jig 40 which is attached to the clamping portion 43 at one end is coincident with a predetermined axis D—D. At the other end of spine 46 is a rod clamp arm 47 angularly extending away from spine 46 and having a rod clamp 48 attached to its end. While the alignment arm 44 is in this position the longitudinal axis of the rod clamp arm 47 is coincident with a predetermined axis E—E and the rod clamp 48 attached thereto is fixed in a predetermined position concentric with the predetermined axis C—C. The chosen alignment of the pot 13 being above and perpendicular to the casting groove 10, the prefetermined axis C—C extends along the pouring path through the center of the spout 14 and along the longitudinal axis of the alignment rod 34. The rod clamp 48 concentrically secured therearound is attached to rod clamp arm 47 which extends perpendicularly away from axis C—C along horizontal axis E—E a required distance parallel to the chosen axis of alignment of pour pot 13 to put the spine end thereof slightly past a vertical plane extending upwardly from mounting plate 50 (FIG. 5). When jig 40 is properly positioned, spine 46 extends in a downward direction perpendicular to axis E—E along axis D—D which extends through clamping portion 43 and pivot 41. Alignment arm 44 extends perpendicularly from spine 46 along axis F—F in a vertical plane off set from and parallel to mounting plate 50.

FIG. 5 illustrates the end of the pour pot 13 in greater detail. The pivot 41, stop block 42 and vise 45 are secured to a mounting plate 50 which is secured to the outer shell 32 of the pot 13. A multiplicity of cooling channels 51 pass through the end plate 50 to provide heat sink capability to the mounting plate 50 lowering the rate of heat transfer from the molten metal cast to the metering pin control tower 17 of FIG. 2 which is removably attached to the mounting plate 50 at pivot 41, stop block 42 and vise 45 when the pour pot is mounted for continuous pouring and casting of molten metal. The pivot 41, block stop 42, vise 45, mounting plate 50 and shell 32 are constructed of rigid materials to provide stable basis for alignment of the spout 14. Thus during continuous operation of the system the longitudinal axis of the metering pin 15 and the longitudinal axis of the spout 14 is maintained concentric with axis C—C.

Referring again to FIG. 2, it can be seen that the jig 40 and jig components of FIG. 4 correspond to components of the metering pin control tower 17. Having identical alignment to the alignment arm 44, clamping portion 43, spine 46, rod clamp arm 47 and rod clamp 48 of the FIG. 4 alignment jig 40 are the alignment arm 20, clamping portion 21, main frame 22, metering pin clamp arm 23, and metering pin clamp 24 of the metering pin control tower 17 respectively, the rigidly constructed tower 17 components maintain the longitudinal axis of the metering pin 15 coincident with axis C—C. The tower 17 additionally including a carrying ring 25 at its top to provide for removal of the heavy and hot tower 17 from the pour pot 13 by mechanical means. The tower 17 is adapted to transport metering pin clamp 24 along a stable path to accurately move and closely control the motion of metering pin 15 along axis C—C thereby providing means to initiate, regulate and terminate the flow of molten metal into and through spout 14 in a precise manner. The results are homogeneous molten metal flow, homogeneous cast products, substantial elimination of molten metal spills, and substantial elimination of metering pin induced pour spout freeze ups. Thus pouring and casting productivity and safety are increased by providing an apparatus and method for automatically centering a metering pin in the pouring spout of a molten metal pouring pot.

While this invention has been described in detail with particular reference to one preferred embodiment thereof, it will be understood that many variations and modifications of the present apparatus are possible in light of the above teachings and within the purview of the appended claims without departing from the spirit and intended scope of the invention.

What is claimed is:

1. A method for aligning a pour spout with a molten metal pour pot, comprising the steps of:

predetermining a longitudinal axis of the proper molten metal path exiting through the pour spout;

arranging the pour spout on an alignment rod;

securing the alignment rod to an alignment jig;

adjusting the alignment jig to align the longitudinal axis of the pour spout with the predetermined longitudinal axis;

fixing the pour spout to the pour pot in its aligned position;

removing the alignment rod from the pour spout; and then replacing the alignment rod with a metering pin positioned along the predetermined longitudinal axis.

2. The method according to claim 1, further comprising the step of:

removing the alignment jig;

locating a molten metal metering pin control tower having a metering pin axis such that the metering pin axis is aligned with the predetermined longitudinal axis; and connecting a metering pin to the metering pin control tower along said metering pin axis.

3. The method according to claim 1, wherein the fixing step comprises cementing the pour spout to the pour pot after the pour spout has been aligned.

4. The method according to claim 1, further comprising the step of clamping the alignment jig to the pour pot in a predetermined location.

5. The method according to claim 1, wherein the step of arranging the pour spout on an alignment rod includes inserting the alignment rod through a central bore in the pour spout and securing the pour spout in place on the rod.

6. A method of aligning a metering pin with a pour spout of a molten metal pour pot, comprising the steps of:

predetermining a longitudinal axis of a molten metal path exiting through the pour spout;

aligning the pour spout with said predetermined longitudinal axis by means of an alignment rod and an alignment jig, said rod and said jig being aligned with said predetermined longitudinal axis;

fixing the pour spout to the pour pot in its aligned position;

removing said alignment rod and said alignment jig;

locating a metering pin control tower having a metering pin axis such that the metering pin axis is aligned with the predetermined longitudinal axis; and connecting a metering pin to the metering pin control tower along the metering pin axis.

7. The method according to claim 6, wherein the fixing step comprises cementing the pour spout to the pour pot after the pour spout has been aligned.

8. The method according to claim 6, wherein the step of aligning the pour spout further comprises adapting the outer surface of the alignment rod to correspond with the inner surface of the pour spout in a manner such that each time a pour spout is mounted on the alignment rod substantially identical alignment and position results.

* * * * *